United States Patent [19]

Nakamura et al.

[11] Patent Number: 4,649,104

[45] Date of Patent: Mar. 10, 1987

[54] HEAT DEVELOPABLE LIGHT-SENSITIVE MATERIAL

[75] Inventors: Taku Nakamura; Hiroyuki Hirai, both of Kanagawa, Japan

[73] Assignee: Fuji Photo Film Co., Ltd., Kanagawa, Japan

[21] Appl. No.: 793,055

[22] Filed: Oct. 30, 1985

[30] Foreign Application Priority Data

Oct. 30, 1984 [JP] Japan ..... 59-228551

[51] Int. Cl.[4] ..... G03C 1/06

[52] U.S. Cl. ..... 430/617; 430/619; 430/620; 430/955; 430/203; 430/351; 430/353; 430/599; 430/562

[58] Field of Search ..... 430/617, 619, 620, 955, 430/203, 351, 353, 559, 562

[56] References Cited

U.S. PATENT DOCUMENTS 3,220,846 11/1965 Tinker et al. ..... 430/619

4,499,172 2/1985 Hirai et al. ..... 430/619

*Primary Examiner*—Won H. Louie

*Attorney, Agent, or Firm*—Sughrue, Mion, Zinn, Macpeak, and Seas

[57] ABSTRACT

A heat developable light-sensitive material is described, comprising a polymer containing as a constituent a repeating unit represented by formula (I)

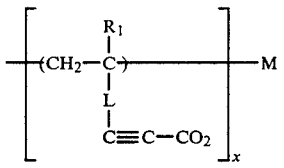

(I)

wherein $R_1$ represents a hydrogen atom or a substituted or unsubstituted alkyl group having from 1 to 6 carbon atoms; L represents a divalent connecting group having from 1 to 20 carbon atoms; M represents a cation and x represents a number which is the same as the charge number of the cation represented by M.

The polymer containing the repeating unit represented by formula (I) is a base precursor which is stable at normal temperature, but rapidly decomposes to release a base by heating; therefore, the heat developable light-sensitive material containing the base precursor has excellent preservability and provides images having good image quality, i.e., low fog density and high image density, upon a short period of developing time.

18 Claims, No Drawings

HEAT DEVELOPABLE LIGHT-SENSITIVE MATERIAL

FIELD OF THE INVENTION

The present invention relates to a heat developable light-sensitive material containing a base precursor. More particularly, the present invention relates to a heat developable light-sensitive material containing a novel base precursor having improved development activity and preservability. The term "precursor" as used herein means a compound which thermally decomposes and releases a basic component by heating.

BACKGROUND OF THE INVENTION

Into heat developable light-sensitive materials, bases or base precursor are frequently incorporated for the purpose of accelerating development by heat. From the viewpoint of preservability of the light-sensitive materials, it is more preferred to employ base precursors which release basic substance upon thermal decomposition. In order to employ such a base precursor in practical use, it is necessary for the precursor to fulfill two somewhat contradictory properties, i.e., stability at normal temperature (e.g., 20° C.), but rapid decomposability at the time of heating.

Basic precursors which have heretofore been known include, for example, a urea as described in U.S. Pat. No. 2,732,299 and Belgian Pat. No. 625,554, a method using urea or urea and an ammonium salt of a weak acid (as described in Japanese Patent Publication No. 1699/65), a method using hexamethylenetetramine or semicarbazide (as described in U.S. Pat. No. 3,157,503), a method using a triazine compound and a carboxylic acid (as described in U.S. Pat. No. 3,493,374), a dicyandiamide derivative (as described in U.S. Pat. No. 3,271,155), an N-sulfonyl urea (as described in U.S. Pat. No. 3,420,665), amine imides (as described in *Research Disclosure,* No. 15776 (1977)), and a salt of a thermally decomposable acid such as a trichloroacetate (as described in British Pat. No. 998,949), etc.

However, image forming materials using these base precursors have serious defects. Specifically, these compounds cannot fulfill the above described indispensable conditions, i.e., good stability during preservation at normal temperature and rapid decomposition at the time of development processing, and cause problems in that a high image density cannot be obtained, or the S/N (signal/noise) ratio of the image is seriously decreased due to release of the base during preservation.

In order to overcome these defects it has been proposed to use salts of sulfonylacetic acid, as described in Japanese Patent Application (OPI) No. 168441/84 (the term "OPI" as used herein refers to a "published unexamined Japanese patent application"), and salts of propiolic acid, as described in Japanese Patent Application No. 55700/83. While these base precursors are excellent from the viewpoint of obtaining images of a high density in a short period of time, stability during preservation thereof is still insufficient. In particular, when preserved under conditions of high temperature or high humidity, they cause problems of fog and desensitization.

SUMMARY OF THE INVENTION

Therefore, an object of the present invention is to provide a heat developable light-sensitive material which has good development activity, can provide an image having a high density and low fog, and is excellent in stability during preservation (which means that changes in photographic properties such as maximum density, minimum density, sensitivity, etc., are small during preservation of the light-sensitive material prior to exposure and heat development processing).

Other objects of the present invention will become apparent from the following detailed description and examples.

These objects of the present invention are accomplished with a heat developable light-sensitive material comprising a polymer base precursor containing as a constituent a repeating unit represented by formula (I)

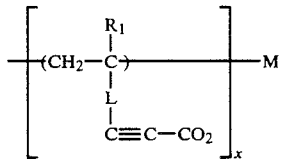

(I)

wherein $R_1$ represents a hydrogen atom or a substituted or unsubstituted alkyl group having from 1 to 6 carbon atoms; L represents a divalent connecting group having from 1 to 20 carbon atoms; M represents a cation; and x represents a number which is the same as the charge number of the cation represented by M.

DETAILED DESCRIPTION OF THE INVENTION

The heat developable light-sensitive material of the present invention is characterized by containing as a base precursor a polymer containing the repeating unit represented by formula (I) described above.

The unit represented by formula (I) is described in more detail below.

In formula (I), $R_1$ represents a hydrogen atom or a substituted or unsubstituted lower alkyl group having from 1 to 6 carbon atoms, for example, a methyl group, an ethyl group, a hydroxyethyl group, an n-propyl group, an n-butyl group, an n-amyl group, an n-hexyl group, etc. Of these groups, a hydrogen atom and a methyl group are particularly preferred.

L in formula (I) represents a divalent connecting group having from 1 to 20 carbon atoms, for example, an alkylene group (for example, a methylene group, an ethylene group, a trimethylene group, a hexamethylene group, etc.), a phenylene group (for example, an o-phenylene group, a p-phenylene group, an m-phenylene group, etc.), an arylenealkylene group (for example,

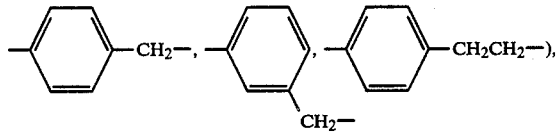

a divalent group containing an amido bond (for example, —CONHCH$_2$—, —CONHCH$_2$CH$_2$—, —CONH—(CH$_2$)$_5$—

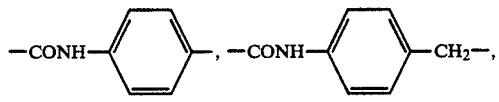

-continued

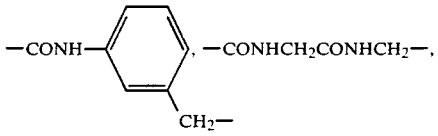

$-CONHCH_2CONHCH_2CH_2-$, $-CONHCH_2CH_2CONHCH_2CH_2-$,

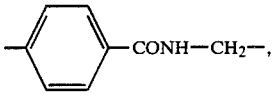

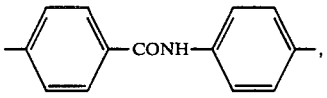

$-CONHCH_2NHCOCH_2CH_2SO_2CH_2CH_2-$, $-CONHCH_2NHCOCH_2SO_2CH_2CH_2-$,

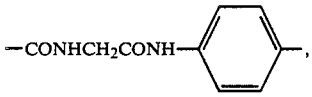

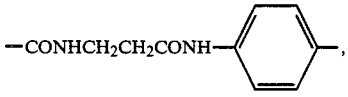

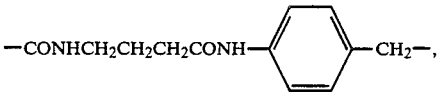

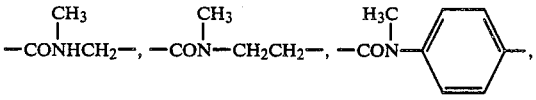

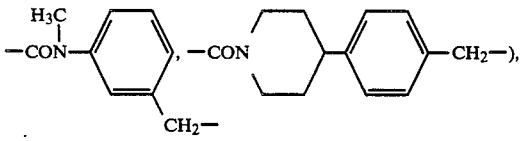

a divalent group containing a sulfonamido bond (for example, $-SO_2NHCH_2-$, $-SO_2NHCH_2CH_2-$, $-SO_2NHCH_2CH_2CH_2-$,

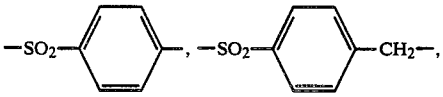

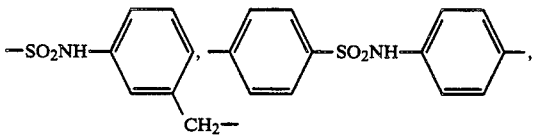

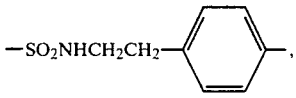

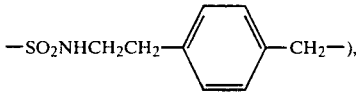

etc. Of these groups, a p-phenylene group, an m-phenylene group,

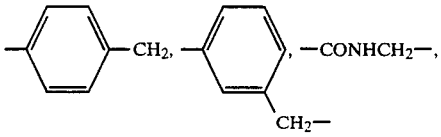

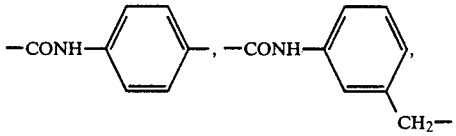

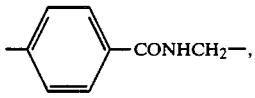

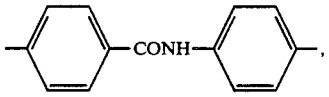

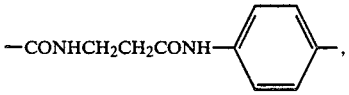

$-CONHCH_2CH_2CONH-$, $-CONHCH_2NHCOCH_2CH_2SO_2CH_2CH_2-$, $-CONHCH_2NHCOCH_2SO_2CH_2CH_2-$,

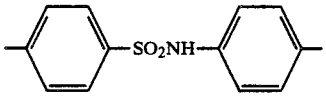

are preferred.

The cation represented by M in formula (I) includes an alkali metal ion (for example, a lithium ion, a sodium ion, a potassium ion, a cesium ion, etc.), an alkaline earth metal ion (for example, a calcium ion, a barium ion, etc.), a quaternary ammonium ion (for example, a tetramethylammonium ion, a tetrabutylammonium ion, a trimethyl benzylammonium ion, a cetyl trimethylammonium ion, etc.), a protonated base (for example, triethylamine, diethylamine, dimethyl benzylamine, diazabiscycloundecene, diazabiscyclooctane, guanidine, methylguanidine, methylenebisguanidine, etc., each protonated), etc. Of these ions, a sodium ion, a potassium ion, a cesium ion, a barium ion, a quaternary ammonium ion having 8 or less carbon atoms in total (for example, a tetramethylammonium ion, etc.) and a protonated base having a pKa of 7 or more (for example, triethylamine, diethylamine, guanidine, methylguanidine, etc., each protonated) are preferred.

Preferred polymer base precursors according to the present invention are salts of polymer carboxylic acids capable of being decarboxylated at a temperature ranging from 80° C. to 250° C., and preferably from 100° C. to 200° C.

Specific examples of preferred repeating units represented by the above described formula (I) according to the present invention are set forth below.

(1)

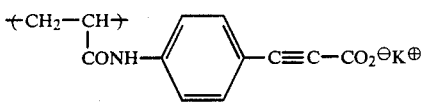

(2)

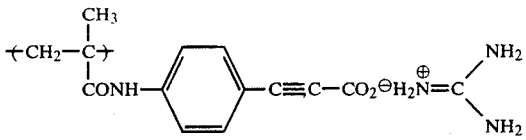

(3)

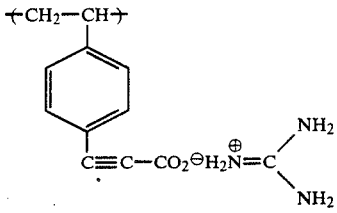

(4)

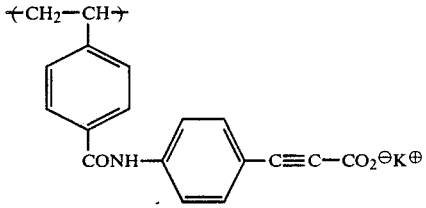

(5)

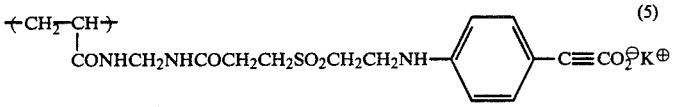

(6)

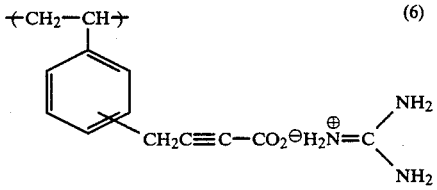

(7)

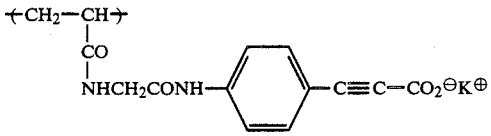

(8)

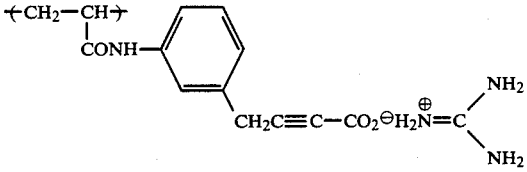

(9)

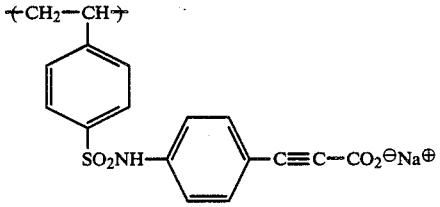

(10)

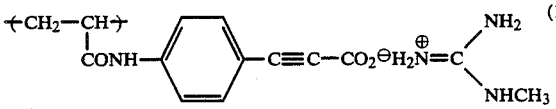

(11)

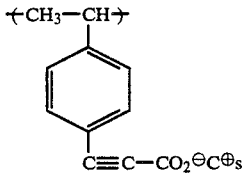

(12)

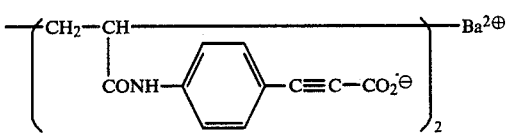

(13)

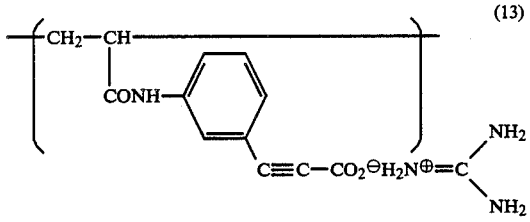

(14)

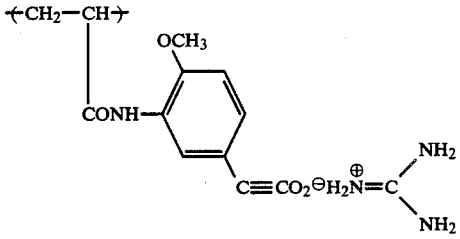

-continued (15)

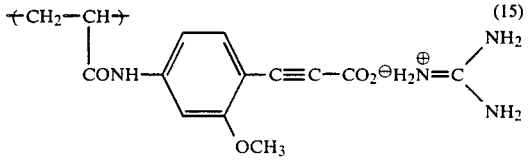

(16)

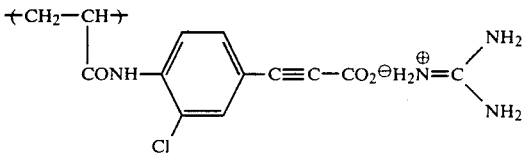

(17)

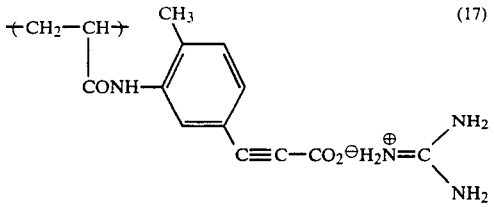

(18)

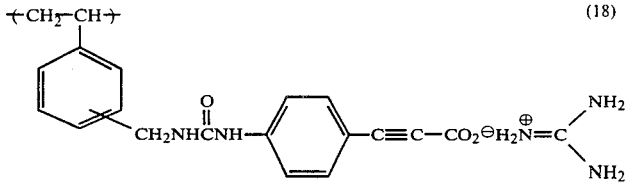

(19)

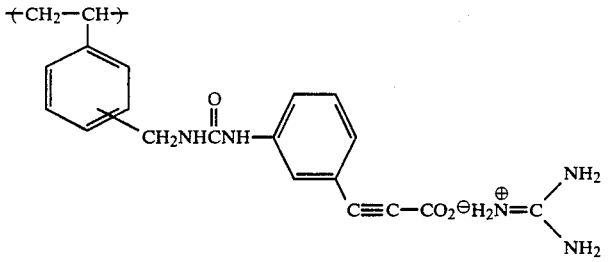

(20)

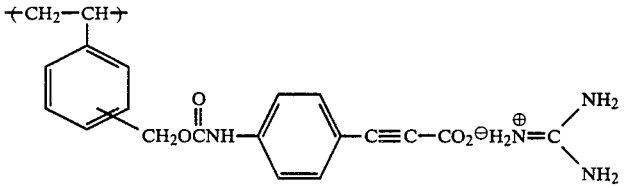

(21)

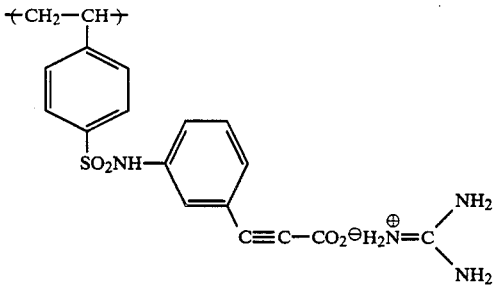

(22)

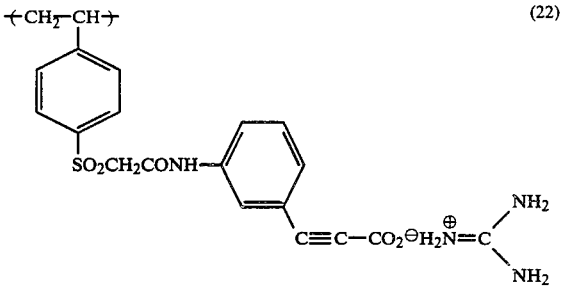

(23)

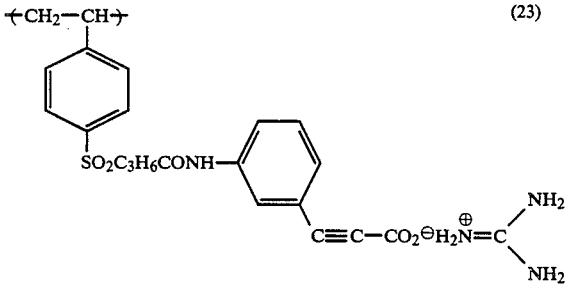

Preferred polymer base precursors according to the present invention may contain one or more kinds of other repeating units in addition to the repeating unit represented by the above described formula (I), e.g., for the purpose of controlling solubility or the glass transition point. Examples of such repeating units include units derived from vinyl monomers. Preferred vinyl monomers include, for example, ethylene, propylene, 1-butene, isobutene, styrene, sodium vinylbenzene-sulfonate, α-methylstyrene, vinyltoluene, potassium vinylbenzylsulfonate, a monoethylenically unsaturated ester of an aliphatic acid (for example, vinyl acetate, allyl acetate, etc.), a monoethylenically unsaturated amide of an aliphatic acid (for example, N-vinylacetamide, N-vinylpyrrolidone, etc.), an ethylenically unsaturated monocarboxylic acid or dicarboxylic acid or a salt thereof (for example, acrylic acid, sodium acrylate, methacrylic acid, sodium methacrylate, itaconic acid, maleic acid, etc.), an ester of an ethylenically unsaturated monocarboxylic acid or dicarboxylic acid (for example, methyl methacrylate, ethyl acrylate, n-butyl acrylate, n-butyl methacrylate, benzyl acrylate, diethyl maleate, diethyl itaconate, etc.), an amide of an ethylenically unsaturated monocarboxylic acid (for example, acrylamide, dimethylacrylamide, methacrylamide, diacetoneacrylamide, acryloylmorpholine, sodium 2-methyl-2-acrylamidopropanesulfonate, etc.), a monoethylenically unsaturated compound (for example, acrylonitrile, etc.), or a diene (for example, butadiene, isoprene, etc.). Of these vinyl monomers, styrene, an ethylenically unsaturated monocarboxylic acid or salt thereof, an ester of an ethylenically unsaturated carboxylic acid, and an amide of an ethylenically unsaturated carboxylic acid are particularly preferred.

In order to prepare a cross-linking latex of preferred polymer base precursor according to the present invention, a vinyl monomer having two or more copolymerizable unsaturated bonds in its molecule can be used.

Specific examples of such vinyl monomers include divinylbenzene, ethylene glycol dimethacrylate, propylene glycol dimethacrylate, methylenebisacrylamide, ethylene glycol diacrylate, etc. Of these monomers, divinylbenzene, ethylene glycol dimethacrylate and ethylene glycol diacrylate are particularly preferred.

The repeating unit represented by formula (I) described above is preferably present in an amount of from 10 mol% to 100 mol%, and particularly from 50 mol% to 100 mol%, in the polymer base precursor according to the present invention.

It is preferred that a molecular weight of the polymer base precursor is 10,000 or more in view of photographic properties, coatability, etc. Further, in the case of using the polymer base precursor in the form of a solution, a preferred molecular weight is 1,000,000 or less, and particularly preferably 300,000 or less, considering the coatability thereof. On the other hand, when a vinyl monomer unit having two or more copolymerizable unsaturated bonds in its molecule is employed as a vinyl monomer unit, the molecular weight of the polymer becomes infinity, and the polymer is used as a dispersion from the standpoint of coatability.

Specific examples of preferred polymer base precursors used in the present invention are set forth below.

P1

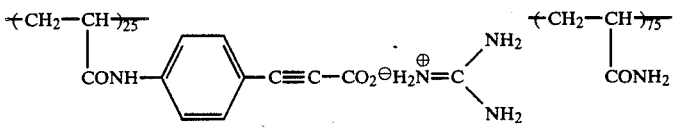

P2

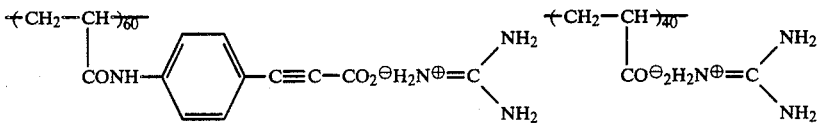

P3

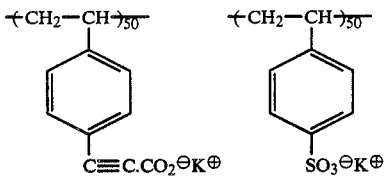

P4

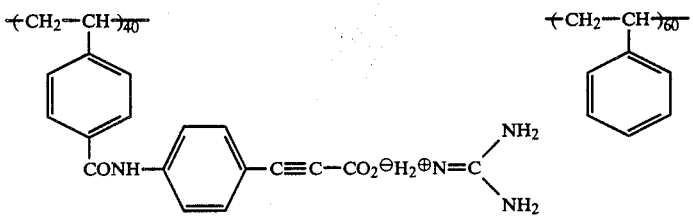

P5

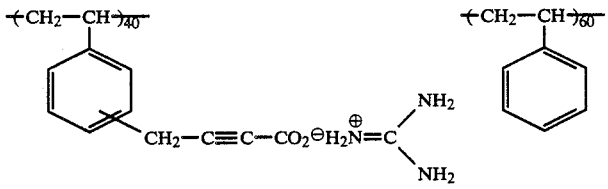

P6

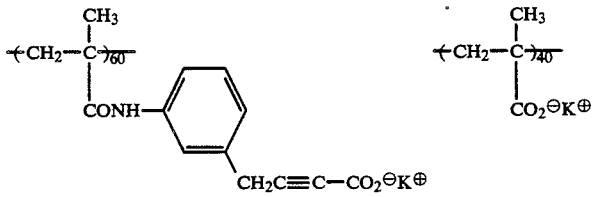

-continued

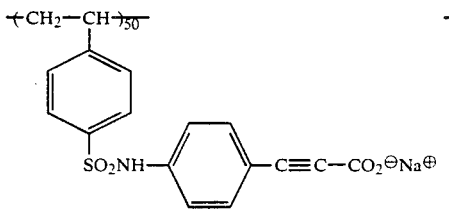

P7

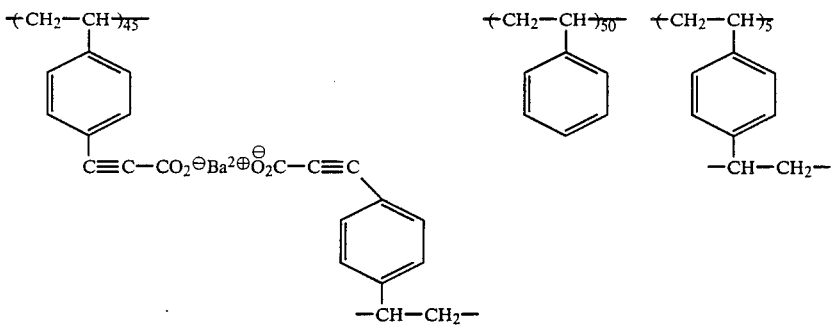

P8

The base precursors according to the present invention can be synthesized, for example, in the following manners:

(1) By a method in which a base precursor monomer capable of releasing a basic component upon thermal decomposition is polymerized alone or copolymerized together with one or more other vinyl monomers.

(2) By a method in which an ester of a carboxylic acid which is decarboxylated upon thermal decomposition is polymerized alone or copolymerized together with one or more other vinyl monomers, and then the ester portion thereof is reacted with a corresponding base.

(3) By a method in which a compound having an ester group of a carboxylic acid which is decarboxylated upon thermal decomposition or a nucleophilic reactive group such as an amino group, a hydroxy group, etc., is reacted with a vinyl polymer having an electrophilic reactive group such as an acid chloride, an active ester, an active vinyl, an active halide, etc., and then the ester portion thereof is reacted with a corresponding base.

In the following, methods for syntheses of preferred base precursors according to the present invention are specifically illustrated.

SYNTHESIS EXAMPLE 1

Synthesis of Poly(guanidine p-acryloylaminophenylpropiolate-co-guanidine Acrylate) P2

106 ml of dimethylformamide (DMF) and 45.2 g of acrylic chloride were placed in a 1 l reaction vessel and the air in the vessel was thoroughly replaced with a nitrogen gas. The mixture was heated at 70° C., and while the temperature was kept constant, 0.62 g of 2,2'-azobis(2,4-dimethylvaleronitrile) was added thereto. After 1 hour and 30 minutes, 0.62 g of the same compound was added to the mixture and the mixture was then heated for 2 hours with stirring. The reaction solution was cooled with ice water, to which was added 28.8 g of pyridine. 52.6 g of methyl p-aminophenylpropiolate was added dropwise at 5° C. over a period of about 1 hour, and after the completion of the dropwise addition, the mixture was stirred at room temperature for 2 hours. Then, 53 ml of water was added to the mixture, the mixture was heated at 50° C. and a solution containing 90 g of guanidine carbonate dissolved in 300 ml of water was added dropwise over a period of 30 minutes. The mixture was further heated for 1 hour, the reaction solution was cooled to room temperature, dialyzed for 3 days in a cellulose dialysis tube, and freeze-dried to obtain 66.1 g (yield: 63%) of the pale yellow colored polymer.

SYNTHESIS EXAMPLE 2

Synthesis of Poly(potassium m-methacryloylaminobenzylpropiolate-co-potassium Methacrylate) P6

36 ml of dimethylformamide (DMF) and 20.9 g of methacrylic chloride were placed in a 500 ml reaction vessel and the air in the vessel was thoroughly replaced with nitrogen gas. The mixture was heated at 75° C. and while the temperature was kept constant, 0.25 g of 2,2'-azobis(2,4-dimethylvaleronitrile) was added thereto. After 30 minutes, 0.25 g of the same compound was added to the mixture and the mixture was heated for 1 hour and 30 minutes with stirring. The reaction solution was cooled with ice water, to which was added 10.6 g of pyridine. 22.7 g of methyl m-aminobenzylpropiolate was added dropwise at 7° C., and after the completion of the dropwise addition, the mixture was stirred at room temperature for 3 hours. Then, 36 ml of water was added to the mixture, the mixture was heated at 50° C. and a solution containing 11.2 g of potassium hydroxide dissolved in 120 ml of water was added dropwise over a period of 20 minutes. The mixture was further heated for 1 hour, the reaction solution was cooled to room temperature, dialyzed for 3 days in a cellulose dialysis tube, and freeze-dried to obtain 24.9 g (yield: 57%) of the brown colored polymer.

The base precursors of the present invention show particularly remarkable effects when used together with spectrally sensitized light-sensitive silver halide emulsions. That is, when used together with spectrally sensitized light-sensitive silver halide emulsions, the base precursors greatly raise the image density.

Spectral sensitization is effected by using methine dyes or the like. Dyes to be used for spectral sensitization include cyanine dyes, merocyanine dyes, complex cyanine dyes, complex merocyanine dyes, holopolar cyanine dyes, hemicyanine dyes, styryl dyes, and hemioxonol dyes. Particularly useful dyes are those belonging to cyanine dyes, merocyanine dyes, and complex merocyanine dyes. In these dyes, any of nuclei ordinarily used as a basic hetero ring nuclei cyanine dyes can be used. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; those in which these nuclei are fused with an alicyclic hydrocarbon ring and those in which these nuclei are fused with an aromatic ring, i.e., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc. may be used. These nuclei may be substituted in the carbon atoms.

In the merocyanine dyes or coplex merocyanine dyes, 5- or 6-membered hetero ring nuclei such as a pyrazoline-5-one nucleus, a thiohydantoin nucleus, a 2-thiooxazolidine-2,4-dione nucleus, a thiazolidine-2,4-dione nucleus, a rhodanine nucleus, a thiobarbituric acid nucleus, etc. may be used as ketomethylene structure-containing nuclei.

Sensitizing dyes are used suitably in amounts of 0.001 g to 20 g, preferably 0.01 g to 2 g, per 100 g of silver used for preparation of the emulsion.

The base precursors of the present invention may be used in a wide range of amounts, usefully in amounts of 50 wt% or less, more preferably 0.01 wt% to 40 wt% based on the weight of dried coating of the light-sensitive material.

Additionally, the unit and stratum structure of the light-sensitive material in accordance with the present invention may be arbitrary, and the base precursors may be added to various layers of the light-sensitive material but, where light-sensitive layers and dye-providing substance-containing layers are separately provided, they may be added to these layers.

Further, the precursors may be added to interlayers or protective layers. Two or more base precursors may be used in combination. A suitable coating amount of the light-sensitive silver halide employed in the present invention is from 1 mg to 10 g/m$^2$ calculated as an amount of silver.

According to the present invention, silver can be utilized as an image forming substance. Further, various other image forming substances can be employed in various image forming processes.

For instance, couplers capable of forming color images upon reaction with an oxidation product of a developing agent which are used in liquid development processing widely known hitherto can be employed. For example, as magenta couplers, there are 5-pyrazolone couplers, pyrazolobenzimidazole couplers, cyanoacetylcoumarone couplers and open chain acylacetonitrile couplers, etc. As yellow couplers, there are acylacetamide couplers (for example, benzoylacetanilides and pivaloylacetanilides), etc. As cyan couplers, there are naphthol couplers and phenol couplers, etc. It is preferred that these couplers be nondiffusible substances which have a hydrophobic group called a ballast group in the molecule thereof or be polymerized substances. The couplers may be any of the 4-equivalent type and 2-equivalent type to silver ions. Further, they may be colored couplers having a color correction effect or couplers which release a development inhibitor at development processing (so-called DIR couplers).

Further, dyes for forming positive color images by a light-sensitive silver dye bleach processes, for example, those as described in *Research Disclosure,* No. 14433, pages 30–32 (April, 1976), ibid., No. 15227, pages 14–15 (December, 1976) and U.S. Pat. No. 4,235,957, etc., can be employed.

Moreover, leuco dyes as described, for example, in U.S. Pat. Nos. 3,985,565 and 4,022,617, etc., can be used.

Further, dyes to which a nitrogen-containing heterocyclic group have been introduced as described in *Research Disclosure,* No. 16966, pages 54–58 (May, 1978), may be employed.

In addition, dye providing substances which release a mobile dye by utilizing a coupling reaction of a reducing agent oxidized by an oxidation reduction reaction with a silver halide or an organic silver salt at high temperature as described in European Pat. No. 79,056, West German Pat. No. 3,217,853, European Pat. No. 67,455, etc., and dye providing substances which release a mobile dye as a result of an oxidation reduction reaction with a silver halide or an organic silver salt at high temperature as described in European Pat. No. 76,492A, West German Pat. No. 3,215,485, European Pat. No. 66,282, Japanese Patent Application Nos. 28928/83 and 26008/83, etc., can be employed.

Preferred dye providing substances which can be employed in these processes can be represented by the following general formula (CI):

$$(\text{Dye—X})_q\text{—Y} \qquad \text{(CI)}$$

wherein Dye represents a dye which becomes mobile when it is released from the molecule of the compound represented by the general formula (CI); X represents a simple bond or a connecting group; Y represents a group which releases Dye in correspondence or counter-correspondence to light-sensitive silver salts having a latent image distributed imagewise, the diffusibility of Dye released being different from that of the compound represented by formula (CI) and q represents an integer of 1 or 2.

The dye represented by Dye is preferably a dye having a hydrophilic group. Examples of the dye which can be used include azo dyes, azomethine dyes, anthraquinone dyes, naphthoquinone dyes, styryl dyes, nitro dyes, quinoline dyes, carbonyl dyes and phthalocyanine dyes. etc. These dyes can also be used in the form of having temporarily shorter wavelengths, the color of which is recoverable in the development processing.

More specifically, the dyes as described in European Patent No. 76,492A can be utilized.

Examples of the connecting group represented by X include —NR— (wherein R represents a hydrogen atom, an alkyl group, or a substituted alkyl group), —$SO_2$—, —CO—, an alkylene group, a substituted alkylene group, a phenylene group, a substituted phenylene group, a naphthylene group, a substituted naphthylene group, —O—, —SO—, or a group derived by combining together two or more of the foregoing groups.

In the following, preferred embodiments of Y in formula (CI) are described in greater detail.

In one embodiment, Y is selected so that the compound represented by the general formula (CI) is a nondiffusible image forming compound which is oxidized as a result of development, thereby undergoing self-cleavage and releasing a diffusible dye.

An example of Y which is effective for compounds of this type is an N-substituted sulfamoyl group. For example a group represented by formula (CII) is illustrated for Y.

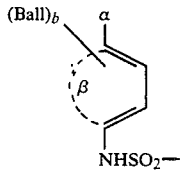

(CII)

wherein

β represents non-metallic atoms necessary for forming a benzene ring, which may optionally be fused with a carbon ring or a hetero ring to form, for example, a naphthalene ring, a quinoline ring, a 5,6,7,8-tetrahydronaphthalene ring, a chroman ring or the like;

α represents a group of —$OG^{11}$ or —$NHG^{12}$ (wherein $G^{11}$ represents hydrogen or a group which forms a hydroxyl group upon being hydrolyzed, and $G^{12}$ represents hydrogen, an alkyl group containing 1 to 22 carbon atoms or a hydrolyzable group);

Ball represents a ballast group; and b represents an integer of 0, 1 or 2.

Specific examples of this type of Y are described in Japanese Patent Application (OPI) Nos. 33826/73 and 50736/78.

Other examples of Y suited for this type of compound are those represented by the following general formula (CIII):

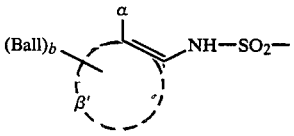

(CIII)

wherein Ball, α and b are the same as defined with (CII), β' represents atoms necessary for forming a carbon ring (e.g., a benzene ring which may be fused with another carbon ring or a hetero ring to form a naphthalene ring, quinoline ring, 5,6,7,8-tetrahydronaphthalene ring, chroman ring or the like. Specific examples of this type of Y are described in Japanese Patent Application (OPI) Nos. 113624/76, 12642/81, 16130/81, 4043/82 and 650/82 and U.S. Pat. No. 4,053,312.

Further examples of Y suited for this type of compound are those represented by the following formula (CIV):

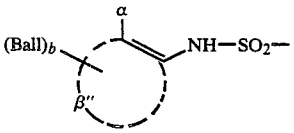

(CIV)

wherein Ball, α and b are the same as defined with the formula (CII), and β'' represents atoms necessary for forming a hetero ring such as a pyrazole ring, a pyridine ring or the like, said hetero ring being optionally bound to a carbon ring or a hetero ring. Specific examples of this type of Y are described in Japanese Patent Application (OPI) No. 104343/76.

Still further examples of Y suited for this type of compound are those represented by the following formula (CV):

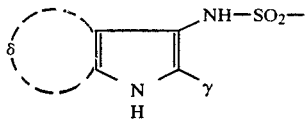

(CV)

wherein γ preferably represents hydrogen, a substituted or unsubstituted alkyl, aryl or heterocyclic group, or —CO—$G^{21}$; $G^{21}$ represents —$OG^{22}$, —$SG^{22}$ or

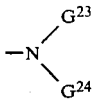

(wherein $G^{22}$ represents hydrogen, an alkyl group, a cycloalkyl group or an aryl group, $G^{23}$ is the same as defined for said $G^{22}$, or $G^{23}$ represents an acyl group derived from an aliphatic or aromatic carboxylic or sulfonic acid, and $G^{24}$ represents hydrogen or an unsubstituted or substituted alkyl group); and δ represents a residue necessary for completing a fused benzene ring.

Specific examples of this type of Y are described in Japanese Patent Application (OPI) Nos. 104343/76, 46730/78, 130122/79 and 85055/82.

Still further examples of Y suited for this type of compound are those represented by the formula (CVI):

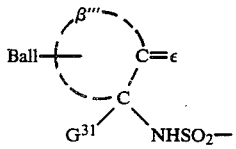

(CVI)

wherein Ball is the same as defined with the formula (CII); ε represents an oxygen atom or =$NG^{32}$ (wherein $G^{32}$ represents hydroxyl or an optionally substituted amino group) (examples of $H_2N$—$G^{32}$ to be used for forming the group of =$NG^{32}$ including hydroxylamine, hydrazines, semicarbazides, thiosemicarbazides, etc.); β''' represents a saturated or unsaturated nonaromatic 5-, 6- or 7-membered hydrocarbon ring; and $G^{31}$ represents hydrogen or a halogen atom (e.g., a fluorine atom, a chlorine atom, a bromine atom, etc.).

Specific examples of this type of Y are described in Japanese Patent Application (OPI) Nos. 3819/78 and 48534/79.

Other examples of Y of this type of compound are described in Japanese Patent Publication Nos. 32129/73, 39165/73, Japanese Patent Application (OPI) No. 64436/74, U.S. Pat. No. 3,443,934, etc.

Still further examples of Y are those represented by the following formula (CVII):

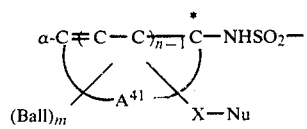

(CVII)

wherein α represents $OR^{41}$ or $NHR^{42}$; $R^{41}$ represents hydrogen or a hydrolyzable component; $R^{42}$ represents hydrogen, or an alkyl group containing 1 to 50 carbon atoms; $A^{41}$ represents atoms necessary for forming an aromatic ring; Ball represents an organic immobile group existing on the aromatic ring, with Ball's being the same or different from each other; m represents an integer of 1 or 2; X represents a divalent organic group having 1 to 8 atoms, with the nucleophilic group (Nu) and an electrophilic center (asterisked carbon atom) formed by oxidation forming a 5- to 12-membered ring. Nu represents a nucleophilic goup; n represents an integer of 1 or 2; and α may be the same as defined with the above described formula (CII). Specific examples of this type of Y are described in Japanese Patent Application (OPI) No. 20735/82.

As still further type of examples represented by the formula (CI), there are dye providing nondiffusible substances which release a diffusible dye in the presence of a base as a result of self cyclization or the like but which, when reacted with an oxidation product of a developing agent, substantially never release the dye.

Examples of Y effective for this type of compound are those which are represented by the formula (CVIII):

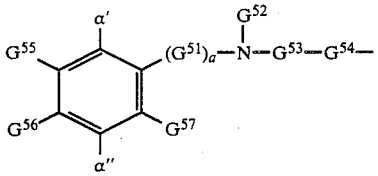

(CVIII)

wherein

α′ represents an oxidizable nucleophilic group (e.g., a hydroxy group, a primary or secondary amino group, a hydroxyamino group, a sulfonamido group or the like) or a precursor thereof;

α″ represents a dialkylamino group or an optional group defined for α′;

$G^{51}$ represents an alkylene group having 1 to 3 carbon atoms;

a represents 0 or 1;

$G^{52}$ represents a substituted or unsubstituted alkyl group having 1 to 40 carbon atoms or a substituted or unsubstituted aryl group having 6 to 40 carbon atoms;

$G^{53}$ represents an electrophilic group such as —CO— or —CS—;

$G^{54}$ represents an oxygen atom, a sulfur atom, a selenium atom, a nitrogen atom or the like and, when $G^{54}$ represents a nitrogen atom, it has hydrogen or may be substituted by an alkyl or substituted alkyl group having 1 to 10 carbon atoms or an aromatic residue having 6 to 20 carbon atoms; and $G^{55}$, $G^{56}$ and $G^{57}$ each represents hydrogen, a halogen atom, a carbonyl group, a sulfamyl group, a sulfonamido group, an alkyloxy group having 1 to 40 carbon atoms or an optional group defined for $G^{52}$, $G^{55}$ and $G^{56}$ may form a 5- to 7-membered ring, and $G^{56}$ may represent

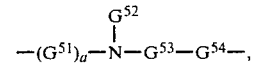

with the proviso that at least one of $G^{52}$, $G^{55}$, $G^{56}$ and $G^{57}$ represents a ballast group. Specific examples of this type of Y are described in Japanese Patent Application (OPI) No. 63618/76.

Further examples of Y suited for this type of compound are those which are represented by the following general formulae (CIX) and (CX):

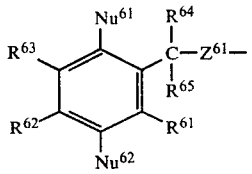

(CIX)

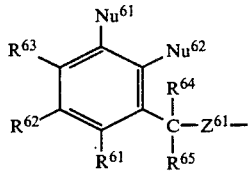

(CX)

wherein $Nu^{61}$ and $Nu^{62}$, which may be the same or different, each represents a nucleophilic group or a precursor thereof; $Z^{61}$ represents a divalent atom group which is electrically negative with respect to the carbon atom substituted by $R^{64}$ and $R^{65}$; $R^{61}$, $R^{62}$ and $R^{63}$ each represents hydrogen, a halogen atom, an alkyl group, an alkoxy group or an acylamino group or, when located at adjacent positions on the ring, $R^{61}$ and $R^{62}$ may form a fused ring together with the rest of the molecule, or $R^{62}$ and $R^{63}$ may form a fused ring together with the rest of the molecule; $R^{64}$ and $R^{65}$, which may be the same or different, each represents hydrogen, a hydrocarbon group or a substituted hydrocarbon group; with at least one of the substituents, $R^{61}$, $R^{62}$, $R^{63}$, $R^{64}$ and $R^{65}$ having a ballast group, Ball, of an enough size so as to render the above described compounds immobile. Specific examples of this type of Y are described in Japanese Patent Application (OPI) Nos. 69033/78 and 130927/79.

Further examples of Y suited for this type of compound are those which are represented by the formula (CXI):

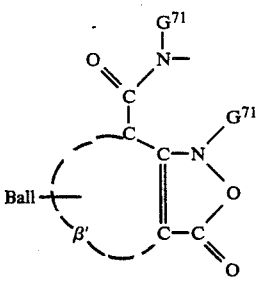

(CXI)

wherein Ball and β′ are the same as defined for those in formula (CIII), and $G^{71}$ represents an alkyl group (including a substituted alkyl group). Specific examples of this type of Y are described in Japanese Patent Application (OPI) Nos. 111628/74 and 4819/77.

As different type of compound represented by the general formula (CI), there are illustrated dye providing nondiffusible substances which themselves do not release any dye but, upon reaction with a reducing agent, release a dye. With these compounds, compounds which mediate the redox reaction (called electron donors) are preferably used in combination.

Examples of Y effective for this type of compound are those represented by the formula (CXII):

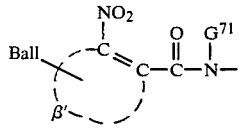

(CXII)

wherein Ball and $\beta'$ are the same as defined for those in the general formula (CIII), and $G^{71}$ represents an alkyl group (including a substituted alkyl group). Specific examples of this type of Y are described in Japanese Patent Application (OPI) Nos. 35533/78 and 110827/78.

Further examples of Y suited for this type of compound are those which are represented by (CXIII):

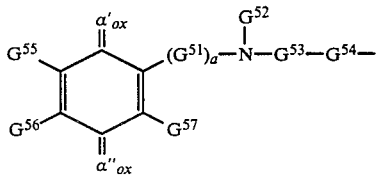

(CXIII)

wherein $\alpha'_{ox}$ and $\alpha''_{ox}$ represent groups capable of giving $\alpha'$ and $\alpha''$, respectively, upon reduction, and $\alpha'$, $\alpha''$, $G^{51}$ $G^{52}$, $G^{53}$, $G^{54}$, $G^{55}$, $G^{56}$, $G^{57}$ and a are the same as defined with respect to formula (CVIII). Specific examples of Y described above are described in Japanese Patent Application (OPI) No. 110827/78, U.S. Pat. Nos. 4,356,249 and 4,358,525.

Further examples of Y suited for this type of compound are those which are represented by the formulae (CXIV-A) and (CXIV-B):

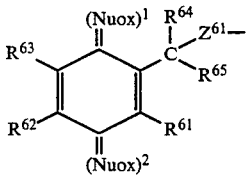

(CXIV-A)

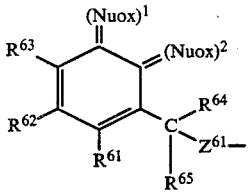

(CXIV-B)

wherein $(Nuox)^1$ and $(Nuox)^2$, which may be the same or different, each represents an oxidized nucleophilic group, and other notations are the same as defined with respect to the formulae (CIX) and (CX). Specific examples of this type of Y are described in Japanese Patent Application (OPI) Nos. 130927/79 and 164342/81.

The publicly known documents having been referred to with respect to (CXII), (CXIII), (CXIV-A) and (CXIV-B) describe electron donors to be used in combination.

As still further different type of compound represented by the general formula (CI), there are illustrated LDA compounds (Linked Donor Acceptor Compounds). These compounds are dye providing non-diffusible substances which cause donor-acceptor reaction in the presence of a base to release a diffusible dye but, upon reaction with an oxidation product of a developing agent, they substantially do not release the dye any more.

Examples of Y effective for this type of compound are those represented by the formula (CXV) (specific examples thereof being described in Japanese Patent Application (OPI) No. 60289/83):

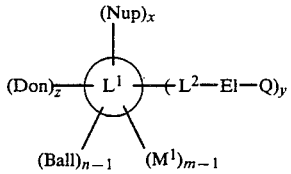

(CXV)

wherein n, x, y and z each represents 1 or 2, m represents an integer of 1 or more; Don represents a group containing an electron donor or its precursor moiety; $L^1$ represents an organic group linking Nup to $-L^2$-El-Q or Don; Nup represents a precursor of a nucleophilic group; El represents an electrophilic center; Q represents a divalent group; Ball represents a ballast group; $L^2$ represents a linking group; and $M^1$ represents a optional substituent.

The ballast group is an organic ballast group which can render the dye providing substance non-diffusible, and is preferably a group containing a $C_{8-32}$ hydrophobic group. Such organic ballast group is bound to the dye providing substance directly or through a linking group (e.g., an imino bond, an ether bond, a thioether bond, a carbonamido bond, a sulfonamido bond, a ureido bond, an ester bond, an imido bond, a carbamoyl bond, a sulfamoyl bond, etc., or combination thereof).

Two or more kinds of the dye providing substances can be employed together. In such a case two or more kinds of the dye providing substances may be used together in order to provide the same hue or in order to reproduce black color.

The dye providing substance used in the present invention can be introduced into a layer of the light-sensitive material by known methods such as the method as described in U.S. Pat. No. 2,322,027. In this case, an organic solvent having a high boiling point or an organic solvent having a low boiling point as described below can be used. For example, the dye providing substance is dispersed in a hydrophilic colloid after dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetate, etc., ethyl propionate, secondary butyl alcohol, methyl isobutyl ketone, β-ethoxyethyl acetate, methyl cellosolve acetate, cyclohexanone, etc. The above described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye providing substance is dispersed in a hydrophilic colloid. For this purpose, the surface active agents illustrated in other part of the specification can be used.

In the present invention, if necessary, a reducing agent may be used. The reducing agents used in the present invention include the following compounds.

Hydroquinone compounds (for example, hydroquinone, 2,5-dichlorohydroquinone, 2-chlorohydroquinone, etc.), aminophenol compounds (for example, 4-aminophenol, N-methylaminophenol, 3-methyl-4-aminophenol, 3,5-dibromoaminophenol, etc.), catechol compounds (for example, catechol, 4-cyclohexylcatechol, 3-methoxycatechol, 4-(N-octadecylamino)catechol, etc.), phenylenediamine compounds (for example, N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.).

Various combinations of developing agents as described in U.S. Pat. No. 3,039,869 can also be used.

In the present invention, an amount of the reducing agent added is from 0.01 mol to 20 mols per mol of silver and more preferably from 0.1 mol to 10 mols per mol of silver.

The silver halide used in the present invention includes silver chloride, silver chlorobromide, silver chloroiodide, silver bromide, silver iodobromide, silver chloroiodobromide and silver iodide, etc.

The process for preparing those silver halides is explained taking the case of silver iodobromide. That is, the silver iodobromide is prepared by first adding silver nitrate solution to potassium bromide solution to form silver bromide particles and then adding potassium iodide to the mixture.

Two or more kinds of silver halides in which a particle size and/or a halogen composition are different from each other may be used in mixture.

An average particle size of the silver halide used in the present invention is preferably from 0.001 μm to 10 μm and more preferably from 0.001 μm to 5 μm.

The silver halide used in the present invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process,* The Fourth Edition, Chapter 5, pages 149–169.

In the particularly preferred embodiment of the present invention, an organic silver salt oxidizing agent is used together. The organic silver salt oxidizing agent is a silver salt which forms a silver image by reacting with the above described image forming substance or a reducing agent coexisting, if necessary, with the image forming substance, when it is heated to a temperature of above 80° C. and, preferably, above 100° C. in the presence of exposed silver halide. By coexisting the organic silver salt oxidizing agent, the light-sensitive material which provides higher color density can be obtained.

Examples of such organic silver salt oxidizing agents include those described in U.S. Pat. No. 4,500,626.

A silver salt of an organic compound having a carboxyl group can be used. Typical examples thereof include a silver salt of an aliphatic carboxylic acid and a silver salt of an aromatic carboxylic acid.

In addition, a silver salt of a compound containing a mercapto group or a thione group and a derivative thereof can be used.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure,* Vol. 170, No. 17029 (June, 1978) and an organic metal salt such as copper stearate, etc., are the organic metal salt oxidizing agent capable of being used in the present invention.

Methods of preparing these silver halide and organic silver salt oxidizing agents and manners of blending them are described in *Research Disclosure,* No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the light-sensitive silver halide and the organic silver salt oxidizing agent employed in the present invention is in a total of from 50 $mg/m^2$ to 10 $g/m^2$ calculated as an amount of silver.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, a cellulose derivative, etc., a polysaccharide such as starch, gum arabic, etc., and a synthetic polymer, for example, a water-soluble polyvinyl compound such as polyvinyl alcohol, polyvinyl pyrrolidone, acrylamide polymer, etc. Another example of the synthetic polymer compound is a dispersed vinyl compound in a latex form which is used for the purpose of increasing dimensional stability of a photographic material.

Further, in the present invention, it is possible to use a compound which activates development simultaneously while stabilizing the image. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)-bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid part such as bis(2-amino-2-thiazolium)methylenebis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

The photosensitive material of the present invention can contain a toning agent as occasion arises. Effective toning agents are 1,2,4-triazoles, 1H-tetrazoles, thiouracils, 1,3,4-thiadiazoles, and like compounds. Examples of preferred toning agents include 5-amino-1,3,4-thiadiazole-2-thiol, 3-mercapto-1,2,4-triazole, bis(dimethylcarbamyl)disulfide, 6-methylthiouracil, 1-phenyl-2-tetrazoline-5-thione, and the like. Particularly effective toning agents are compounds which can impart a black color tone to images.

The content of such a toning agent as described above, though depending upon the kind of a heat developable photosensitive material used, processing conditions, desired images and various other factors, generally ranges from about 0.001 to 0.1 mol per mol of silver in the photosensitive material.

The above described bases or base precursors can be used not only for the acceleration of dye release but also for other purposes such as the control of a pH value.

The above described various ingredients to constitute a heat developable light-sensitive material can be arranged in arbitrary positions, if desired. For instance, one or more of the ingredients can be incorporated in one or more of the constituent layers of a light-sensitive material, if desired. In some cases, it is desired that particular portions of reducing agent, image stabilizing agent and/or other additives should be distributed in a protective layer. As a result of the distribution in the above described manner, migration of additives among constituent layers of a heat developable photosensitive material can be reduced. Therefore, such distribution of additives is of advantage in some cases.

The heat developable light-sensitive materials of the present invention are effective in forming both negative and positive images. The negative or positive image can be formed depending mainly on the type of the light-sensitive silver halide. For instance, in order to produce direct positive images, internal image type silver halide emulsions described in U.S. Pat. Nos. 2,592,250, 3,206,313, 3,367,778 and 3,447,927, or mixtures of surface image type silver halide emulsions with internal image type silver halide emulsions as described in U.S. Pat. No. 2,996,382 can be used.

Various means of exposure can be used in the present invention. Latent images are obtained by imagewise exposure by radiant rays including visible rays. Generally, light sources used for conventional color prints can be used, examples of which include tungsten lamps, mercury lamps, halogen lamps such as iodine lamps, xenon lamps, laser light sources, CRT light sources, fluorescent tubes and light emitting diodes, etc.

In the present invention, after the heat developable color photographic material is exposed to light, the resulting latent image can be developed by heating the whole material to a suitably elevated temperatures. A higher temperature or lower temperature can be utilized to prolong or shorten the heating time, if it is within the above described temperature range.

As the heating means, a simple heat plate, iron, heat roller, heat generator utilizing carbon or titanium white, etc., or analogues thereof may be used.

The sensitizing dyes may be present in the emulsion together with dyes which themselves do not give rise to spectrally sensitizing effects but exhibit a supersensitizing effect or materials which do not substantially absorb visible light but exhibit a super-sensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, etc., can be present. The combinations described in U.S. Pat. Nos. 3,615,613, 3,615,641, 3,617,295 and 3,635,721 are particularly useful.

A support used in the light-sensitive material and the dye fixing material employed, if desired, according to the present invention is that which can endure at the processing temperature. As an ordinary support, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereto or a plastic material may be used. Further, a paper support laminated with a polymer such as polyethylene, etc., can be used. The polyesters described in U.S. Pat. Nos. 3,634,089 and 3,725,070 are preferably used.

In the photographic light-sensitive material and the dye fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloyl-hexahydro-s-triazine, 1,3-vinylsulfonyl-2-propanol, etc.) active halogen compounds (2,4-dichloro-6-hydroxy-s-triazine, etc.), mucohalogenic acids (mucochloric acid, mucophenoxychloric acid, etc.), etc., which are used alone or as a combination thereof.

The transfer of dyes from the light-sensitive layer to the dye fixing layer can be carried out using a dye transfer assistant.

The dye transfer assistants suitably used in a process wherein it is supplied from the outside include water and an aqueous solution containing sodium hydroxide, potassium hydroxide or an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant may be used by wetting the image receiving layer with the transfer assistant.

When the dye transfer assistant is incorporated into the light-sensitive material or the dye fixing material, it is not necessary to supply the transfer assistant from the outside. In this case, the above described dye transfer assistant may be incorporated into the material in the form of water of crystallization or microcapsules or as a precursor which releases a solvent at a high temperature.

More preferred process is a process wherein a hydrophilic thermal solvent which is solid at an ambient temperature and melts at a high temperature is incorporated into the light-sensitive material or the dye fixing material. The hydrophilic thermal solvent can be incorporated either into any of the light-sensitive material and the dye fixing material or into both of them. Although the solvent can be incorporated into any of the emulsion layer, the interlayer, the protective layer and the dye fixing layer, it is preferred to incorporate it into the dye fixing layer and/or adjacent layers thereto.

Examples of the hydrophilic thermal solvents include ureas, pyridines, amides, sulfonamide, imides, alcohols, oximes and other heterocyclic compounds.

Other compounds which can be used in the photosensitive material of the present invention, for example, sulfamide derivatives, cationic compounds containing a pyridinium group, surface active agents having polyethylene oxide chains, sensitizing dye, antihalation and anti-irradiation dyes, hardeners, mordants and so on, are those described in U.S. Pat. Nos. 4,500,626, 4,478,927, 4,463,079, and Japanese Patent Application Nos. 28928/83 (corresponding to U.S. Patent Application Ser. No. 582,655, filed on Feb. 23, 1984) and U.S. Pat. No. 4,503,137. Methods for the exposure and so on cited in the above described patents can be employed in the present invention also.

In accordance with the present invention, heat developable light-sensitive materials having good development activity and capable of providing images of a high density and low fog are obtained due to use of the polymer having as a constituent a repeating unit represented by formula (I) described above. Further, heat developable light-sensitive materials are obtained in which degradation of photographic properties (such as maximum density, minimum density, sensitivity, etc.) is prevented during preservation of the light-sensitive material prior to heat development processing; that is, the materials are excellent in stability during preservation before use.

The present invention is explained in greater detail with reference to the following examples, but the present invention should not be construed as being limited thereto.

EXAMPLE 1

Preparation of Silver Iodobromide Emulsion 40 g of gelatin and 26 g of potassium bromide (KBr) were dissolved in 3,000 ml of water and the solution was maintained at 50° C. with stirring. A solution of 34 g of silver nitrate dissolved in 200 ml of water was added to the above prepared solution over a 10 minute period. Then, a solution of 3.3 g of potassium iodide (KI) dissolved in 100 ml of water was added over a 2 minute period. The thus prepared silver iodobromide emulsion was adjusted in pH, precipitated, and freed of excess salts. It was then adjusted to a pH of 6.0, whereby 400 g of a silver iodobromide emulsion was obtained.

Preparation of Dispersion of Coupler in Gelatin

A mixture of 4.8 g of 2-octylcarbamoyl-1-naphthol, 0.5 g of sodium dodecylbenzenesulfonate, 2.5 g of tricresyl phosphate (TCP) and 30 ml of ethyl acetate was dissolved. This solution was mixed with 100 g of a 10% aqueous solution of gelatin with stirring and the mixture was dispersed by means of a homogenizer at 10,000 rpm for 10 minutes.

A coating solution having the composition shown below was coated on a polyethylene terephthalate support at a wet layer thickness of 60 μm and dried to prepare Light-Sensitive Material A.

| | | |
|---|---|---|
| (a) | Silver iodobromide emulsion | 10 g |
| (b) | Dispersion of coupler in gelatin | 4.0 g |
| (c) | Polymer Base Precursor P2 according to the present invention (10% aq. soln.) | 7.0 ml |
| (d) | Gelatin (10% aq. soln.) | 5 g |
| (e) | Solution containing 0.2 g of 2,6-dichloro-p-aminophenol dissolved in 17 ml of water | |

Further, in the same manner as described for Light-Sensitive Material A except using 7.0 ml of Polymer Base Precursor P6 (10% aqueous solution), and 2.4 ml of guanidine trichloroacetate (5% aqueous solution), respectively, in place of Polymer Base Precursor P2 of the above described component (c) to prepare Light-Sensitive Materials B and C.

Light-Sensitive Materials A, B, and C thus prepared were, just after the preparation, and after preservation at a temperature of 60° C. for 2 days, exposed imagewise at 2,000 lux for 5 seconds using a tungsten lamp and then uniformly heated for 30 seconds on a heat block which had been heated to 150° C., whereby negative cyan color images were obtained.

The densities of these cyan color images were measured using a Macbeth transmission densitometer TD-504), and the results thus obtained are shown in Table 1.

TABLE 1

| Light-Sensitive Material | Base Precursor | Just after Preparation | | After Preservation at 60° C. for 2 Days | |
|---|---|---|---|---|---|
| | | Maximum Density | Minimum Density | Maximum Density | Minimum Density |
| A (Present Invention) | P2 | 1.87 | 0.26 | 1.90 | 0.28 |
| B (Present Invention) | P6 | 1.82 | 0.25 | 1.93 | 0.34 |
| C (Comparison) | Guanidine trichloroacetate | 1.91 | 0.32 | 1.96 | 1.36 |

As is apparent from the results shown in Table 1, Light-Sensitive Material C using guanidine trichloroacetate as described in U.S. Pat. No. 3,220,846 provides an image of a high density just after preparation, but causes greatly increased fog after preservation. On the contrary, Light-Sensitive Materials A and B using Polymer Base Precursors P2 and P6 according to the present invention, respectively, provide images of high density and low fog both just after preparation and after preservation; thus, it is clear that the light-sensitive materials of the present invention are excellent in both development activity and stability during preservation.

EXAMPLE 2

The same silver iodobromide emulsion as described in Example 1 and the following dispersion of dye providing substance were employed.

Preparation of Dispersion of Dye Providing Substance

A mixture of 5.2 g of a dye providing substance having the structure shown below, 0.5 g of sodium dodecylbenzenesulfonate, as a surface active agent, 5 g of tricresyl phosphate (TCP) and 30 ml of ethyl acetate was dissolved by heating at about 60° C. This solution was mixed with 100 g of a 10% aqueous solution of gelatin with stirring and the mixture was dispersed by means of a homogenizer at 10,000 rpm for 10 minutes.

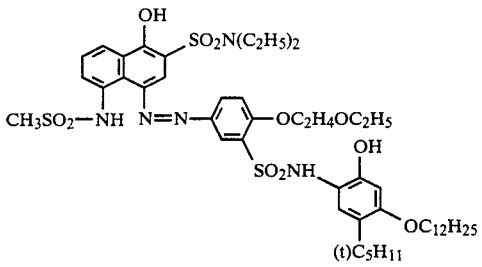

CI-16

In the following a preparation method of a light-sensitive coating is described.

| | | |
|---|---|---|
| (a) | Light-sensitive silver iodobromide emulsion (same as described in Example 1) | 25 g |
| (b) | Dispersion of dye providing substance | 33 g |
| (c) | 5% Aqueous solution of compound having the following formula | 10 ml |
| | 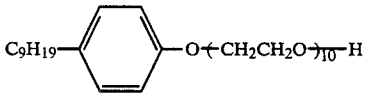 | |
| (d) | 10% Aqueous solution of compound having the following formula $H_2NSO_2N(CH_3)_2$ | 4 ml |
| (e) | Polymer Base Precursor P2 according to the present invention (20% aq. soln.) | 25 ml |

The above components (a) to (e) were mixed and dissolved by heating and the mixture was coated on a polyethylene terephthalate film at a wet layer thickness of 30 μm and dried to prepare Light-Sensitive Material D.

Further, in the same manner as described for Light-Sensitive Material D, except using the base precursors shown in Table 2, respectively, in place of Polymer Base Precursor P2 of the above described component (e), Light-Sensitive Materials E and F were prepared.

TABLE 2

| Light-Sensitive Material | Base Precursor | | Amount Added ml |
|---|---|---|---|
| D (Present Invention) | P2 | (20% aq. soln.) | 25 |
| E (Present Invention) | P6 | (20% aq. soln.) | 25 |
| F (Comparison) | Guanidine Trichloro-acetate | (7% aq. soln.) | 25 |

In the following a preparation method of an image receiving material having an image receiving layer is described.

12 g of poly(styrene-co-N,N,N-trimethyl-N-vinylbenzylammonium chloride) (molar ratio of styrene to vinylbenzylammonium chloride was 1/1) was dissolved in 200 ml of water and then uniformly mixed with 100 g of a 10% aqueous solution of lime-processed gelatin. The resulting mixture was uniformly coated at a wet layer thickness of 90 μm on a paper support laminated with polyethylene with titanium dioxide dispersed therein. The thus prepared material was dried and then used as an image receiving material.

Light-Sensitive Materials D, E, and F were, just after preparation and after preservation at a temperature of 60° C. for 2 days, exposed imagewise at 2,000 lux for 10 seconds using a tungsten lamp, and then uniformly heated for 30 seconds on a heat block which had been heated to 140° C.

The above described image receiving material was soaked in water and then superimposed on each of the above heated Light-Sensitive Materials D, E, and F in such a manner that their coated layers were in contact with each other.

After heating for 7 seconds on a heat block maintained at 80° C., the image receiving material was separated from the light-sensitive material, whereupon a negative magenta color image was obtained in the image receiving material.

The densities of these magenta color images were measured using a Macbeth reflection densitometer (RD-519), and the results thus obtained are shown in Table 3.

TABLE 3

| Light-Sensitive Material | Base Precursor | Just after Preparation | | After Preservation at 60° C. for 2 Days | |
|---|---|---|---|---|---|
| | | Maximum Density | Minimum Density | Maximum Density | Minimum Density |
| D (Present Invention) | P2 | 1.77 | 0.19 | 1.81 | 0.25 |
| E (Present Invention) | P6 | 1.82 | 0.23 | 1.84 | 0.24 |
| F (Comparison) | Guanidine Trichloro-acetate | 1.86 | 0.19 | 1.95 | 1.44 |

As is apparent from the results shown in Table 3, Light-Sensitive Material F using guanidine trichloroacetate provided an image of a high density just after preparation, but caused a severe increase in fog after preservation. On the contrary, Light-Sensitive Materials D and E using Polymer Base Precursors P2 and P6 according to the present invention respectively provide images of high density and low fog both just after preparation and after preservation; thus, it is clear that the light-sensitive materials of the present invention are excellent in both development activity and stability during preservation.

EXAMPLE 3

Preparation of Silver Benzotriazole Emulsion Containing Light-Sensitive Silver Bromide 10 g of gelatin and 6.5 g of benzotriazole were dissolved in 1,000 ml of water and the solution was maintained at 50° C. with stirring. A solution of 8.5 g of silver nitrate dissolved in 100 ml of water was added to the above prepared solution over a 2 minute period. Then, a solution of 1.2 g of potassium bromide dissolved in 50 ml of water was added over a 2 minute period. The thus prepared emulsion was adjusted in pH, precipitated, and freed of excess salts. It was then adjusted to a pH of 6.0, whereby 200 g of a silver benzotriazole emulsion containing silver bromide was obtained.

Preparation of Dispersion of Dye Providing Substance in Gelatin

A mixture of 12 g of a dye providing substance having the structure shown below, 0.5 g of sodium dodecylbenzenesulfonate, as a surface active agent, 4 g of tricresyl phosphate (TCP) and 20 ml of cyclohexanone was dissolved by heating at about 60° C. to prepare a uniform solution. This solution was mixed with 100 g of a 10% aqueous solution of lime-processed gelatin with stirring and the mixture was dispersed by means of a homogenizer at 10,000 rpm for 10 minutes.

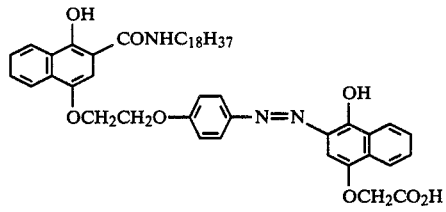

CI-17

In the following, a preparation method of a light-sensitive coating is described

| | | |
|---|---|---|
| (a) | Silver benzotriazole emulsion containing light-sensitive silver bromide | 10 g |
| (b) | Dispersion of dye providing substance | 3.6 g |
| (c) | Polymer Base Precursor P2 according to the present invention (10% aq. soln.) | 6.0 ml |
| (d) | Gelatin (10% aq. soln.) | |
| (e) | Solution containing 200 mg of 2,6-dichloro-4-aminophenol dissolved in 2 ml of methanol | |

The above components (a) to (e) were mixed and dissolved by heating and the mixture was coated on a polyethylene terephthalate film having a thickness of 180 μm at a wet layer thickness of 30 μm and dried to prepare Light-Sensitive Material G.

Further, in the same manner as described for Light-Sensitive Material G, except using 6.0 ml of Polymer Base Precursor P6 (10% aqueous solution) and 3.0 ml of guanidine trichloroacetate (5% aqueous solution), respectively, in place of Polymer Base Precursor P2 of the above described component (c) to prepare Light-Sensitive Materials H and I.

Light-Sensitive Materials, G, H and I thus prepared were, just after preparation and after preservation at a temperature of 60° C. for 2 days, exposed image-wise at 2,000 lux for 10 seconds using a tungsten lamp and then uniformly heated for 30 seconds on a heat block which had been heated at 150° C.

The same procedure as described in Example 2 was conducted using the image receiving material as described in Example 2, and a negative magenta color image was obtained in the image receiving material.

The density of the negative image was measured by means of a Macbeth reflection densitometer (RD-519), and the results thus obtained are shown in Table 4.

TABLE 4

| Light-Sensitive Material | Base Precursor | Just after Preparation | | After Preparation at 60° C. for 2 Days | |
|---|---|---|---|---|---|
| | | Maximum Density | Minimum Density | Maximum Density | Minimum Density |
| G (Present Invention) | P2 | 1.76 | 0.18 | 1.77 | 0.24 |
| H (Present Invention) | P6 | 1.79 | 0.16 | 1.78 | 0.27 |
| I (Comparison) | Guanidine Trichloroacetate | 1.82 | 0.19 | 1.87 | 1.24 |

As is apparent from the results shown in Table 4, Light-Sensitive Material I using guanidine trichloroacetate provided an image of a high density just after preparation, but caused a severe increase in fog after preservation. On the contrary, Light-Sensitive Materials G and H using Polymer Base Precursrs P2 and P6 according to the present invention, respectively, provided images of high density and low fog both just after preparation and after preservation; thus, it is clear that the light-sensitive materials of the present invention are excellent in both development activity and stability during preservation.

EXAMPLE 4

Preparation of Dispersion of Dye Providing Substance in Gelatin

A mixture of 5 g of a reducible dye releasing agent having the structure shown below, 4 g of an electron donative substance having the structure shown below, 0.5 g of sodium dodecylbenzenesulfonate, 10 g of tricresyl phosphate (TCP) and 20 ml of cyclohexanone was dissolved by heating at about 60° C. This solution was mixed with 100 g of a 10% aqueous solution of gelatin with stirring and the mixture was dispersed by means of a homogenizer at 10,000 rpm for 10 minutes. cl Reducible Dye Releasing Agent

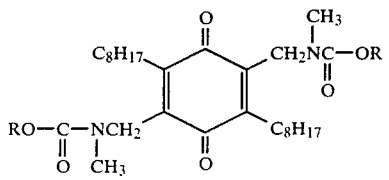

CI-18 wherein R =

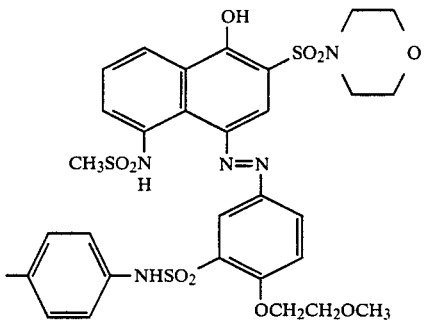

Further, in the same manner as described for Light-Sensitive Material J, except using 6.0 ml of Polymer Base Precursor P6 (10% aqueous solution) and 3.0 ml of guanidine trichloroacetate (5% aqueous solution), respectively, in place of Polymer Base Precursor P2 of the above described component (c), Light-Sensitive Materials K and L were prepared.

Light-Sensitive Materials J, K and L thus prepared were, just after preparation and after preservation at a temperature of 60° C. for 2 days, exposed image-wise at 2,000 lux for 10 seconds using a tungsten lamp, and then uniformly heated for 30 seconds on a heat block which had been heated to 150° C.

The same procedure as described in Example 2 was conducted using the image receiving material as described in Example 2, and a positive magenta color image was obtained in the image receiving material.

The density of the positive image was measured by means of a Macbeth reflection densitometer (RD-519), and the results thus obtained are shown in Table 5.

TABLE 5

| Light-Sensitive Material | Base Precursor | Just after Preparation | | After Preservation at 60° C. for 2 Days | |
|---|---|---|---|---|---|
| | | Maximum Density | Minimum Density | Maximum Density | Minimum Density |
| J (Present Invention) | P2 | 1.72 | 0.31 | 1.70 | 0.33 |
| K (Present Invention) | P6 | 1.69 | 0.30 | 1.73 | 0.29 |
| L (Comparison) | Guanidine Trichloro-acetate | 1.74 | 0.29 | 1.71 | 1.36 |

Electron Donative Substance

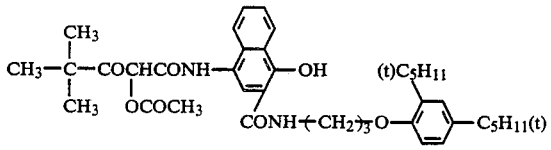

In the following, preparation of a light-sensitive coating is described.

| | | |
|---|---|---|
| (a) | Silver benzotriazole emulsion containing Light-sensitive silver bromide (same as described in Example 3) | 12 g |
| (b) | Dispersion of dye providing substance | 3.6 g |
| (c) | Polymer Base Precursor P2 according to the present invention (10% aq. soln.) | 6.0 ml |
| (d) | 5% Aqueous solution of compound having the following formula | 1.5 ml |

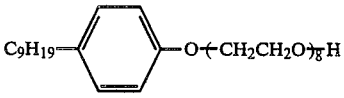

The above components (a) to (d) were mixed and dissolved by heating and the mixture was coated on a polyethylene terephthalate film at a wet layer thickness of 30 μm, and dried to prepare Light-Sensitive Material J.

As is apparent from the results shown in Table 5, Light-Sensitive Material L using guanidine trichloroacetate provided an image of a high density just after preparation, but caused a severe increase in fog after preservation. On the contrary, Light-Sensitive Materials J and K using Polymer Base Precursors P2 and P6 according to the present invention, respectively, provided images of high density and low fog both just after preparation and after preservation; thus, it is clear that the light-sensitive materials of the present invention are excellent in both development activity and stability during preservation.

From the results obtained in Examples 1 to 4 described above, it is clear that the polymer base precursors according to the present invention have good development activity and excellent stability during preservation in heat development light-sensitive materials subjected to various processes, in comparison with conventional base precursors.

While the invention has been described in detail and with reference to specific embodiments thereof, it will be apparent to one skilled in the art that various changes and modifications can be made therein without departing from the spirit and scope thereof.

What is claimed is:

1. A heat developable light-sensitive material comprising a silver halide emulsion, a reducing substance and a polymer base precursor containing as a constituent a repeating unit represented by formula (I)

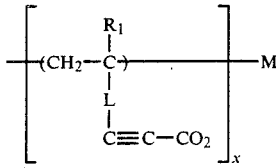

(I)

wherein $R_1$ represents a hydrogen atom or a substituted or unsubstituted alkyl group having from 1 to 6 carbon atoms; L represents a divalent connecting group having from 1 to 20 carbon atoms; M represents a cation; and x represents a number which is the same as the charge number of the cation represented by M.

2. A heat developable light-sensitive material as in claim 1, wherein $R_1$ represents a hydrogen atom or methyl group.

3. A heat developable light-sensitive material as in claim 1, wherein the divalent connecting group represented by L is an alkylene group, a phenylene group, an arylenealkylene group, a divalent group containing an amido bond, or a divalent group containing a sulfonamido bond.

4. A neat developable light-sensitive material as in claim 1, wherein L represents a p-phenylene group, an m-phenylene group,

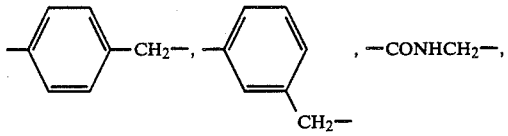

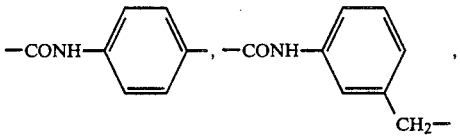

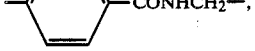

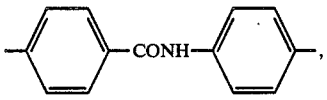

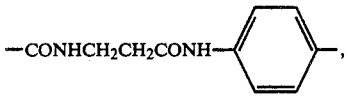

$-CONHCH_2CH_2CONH-$, $-CONHCH_2NHCOCH_2CH_2SO_2CH_2CH_2-$, $-CONHCH_2NHCOCH_2SO_2CH_2CH_2CH_2-$, or

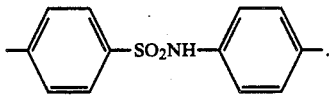

5. A heat developable light-sensitive material as in claim 1, wherein the cation represented by M is an alkali metal ion, an alkaline earth ion, a quaternary ammonium ion, or a protonated base.

6. A heat developable light-sensitive material as in claim 1, wherein M represents a sodium ion, a potassium ion, a cesium ion, a barium ion, a quaternary ammonium ion having 8 or less carbon atoms in total, or a protonated base having a pKa of 7 or more.

7. A heat developable light-sensitive material as in claim 1, wherein the polymer base precursor is a salt of polymer carboxylic acid capable of being decarboxylated at a temperature range from 80° C. to 250° C.

8. A heat developable light-sensitive material as in claim 1, wherein the polymer base precursor is a salt of a polymeric carboxylic acid capable of being decarboxylated at a temperature range from 100° C. to 200° C.

9. A heat developable light-sensitive material as in claim 1, wherein the polymer base precursor is a copolymer containing one or more kinds of other repeating units in addition to the repeating unit represented by formula (I).

10. A heat developable light-sensitive material as in claim 9, wherein the other repeating unit is derived from a monomer selected from ethylene, propylene, 1-butene, isobutene, styrene, sodium vinylbenzenesulfonate, α-methylstyrene, vinyltoluene, potassium vinylbenzylsulfonate, a monoethylenically unsaturated ester of an aliphatic acid, a monoethylenically unsaturated amide of an aliphatic acid, an ethylenically unsaturated monocarboxylic acid or dicarboxylic acid or a salt thereof, an ester of an ethylenically unsaturated monocarboxylic acid or dicarboxylic acid, an amide of an ethylenically unsaturated monocarboxylic acid, a monoethylenically unsaturated compound, and a diene.

11. A heat developable light-sensitive material as in claim 9, wherein the other repeating unit is derived from a monomer selected from styrene, an ethylenically unsaturated monocarboxylic acid or salt thereof, an ester of an ethylenically unsaturated carboxylic acid, and an amide of ethylenically unsaturated carboxylic acid.

12. A heat developable light-sensitive material as in claim 9, wherein the other repeating unit is derived from a vinyl monomer having two or more copolymerizable unsaturated bonds in its molecule.

13. A heat developable light-sensitive material as in claim 12, wherein the vinyl monomer is divinylbenzene, ethylene glycol dimethacrylate, or ethylene glycol diacrylate.

14. A heat developable light-sensitive material as in claim 1, wherein the repeating unit represented by formula (I) is present in an amount of from 10 mol% to 100 mol% in the polymer base precursor.

15. A heat developable light-sensitive material as in claim 1, wherein the repeating unit represented by formula (I) is present in an amount of from 50 mol% to 100 mol% in the polymer base precursor.

16. A heat developable light-sensitive material as in claim 1, wherein the average molecular weight of the polymer base precursor is 10,000 or more.

17. A heat developable light-sensitive material as in claim 1, wherein the material further contains an organic silver salt oxidizing agent.

18. A heat developable light-sensitive material as in claim 1, wherein the light-sensitive material contains an image forming substance which is a dye providing substance.

* * * * *